US006003252A

United States Patent [19]

Davis

[11] Patent Number: 6,003,252

[45] Date of Patent: Dec. 21, 1999

[54] CONVERSION APPARATUS AND METHOD FOR USE WITH EXCAVATOR AND CRANE DEVICES

[76] Inventor: Daniel E. Davis, 3206 Merion Ct., Harlingen, Tex. 78550

[21] Appl. No.: 09/129,279

[22] Filed: Aug. 5, 1998

[51] Int. Cl.[6] ..... E02F 3/76

[52] U.S. Cl. ..... 37/403; 37/466

[58] Field of Search ..... 37/403, 468, 466, 37/406, 407, 409, 903, 443; 172/126; 414/694, 763; 403/315, 306, 307

[56] References Cited

U.S. PATENT DOCUMENTS

| | | | |
|---|---|---|---|
| 5,507,107 | 4/1996 | Pinomaki | 37/403 |
| 5,621,987 | 4/1997 | Pratt et al. | 37/468 |
| 5,653,293 | 8/1997 | Ellis | 172/438 |
| 5,850,704 | 12/1998 | Harinen | 37/468 |

*Primary Examiner*—Robert E. Pezzuto
*Attorney, Agent, or Firm*—Alton W. Payne

[57] ABSTRACT

A crane-excavator apparatus and method is provided. More particularly, the present invention relates to a mobile apparatus adaptable for use as a crane and as an excavator, and an associated method. The crane includes a lower crawler adapted for use with an excavator, an upper body adapted for use with an excavator, a boom adapted to engage a crane body, and an adapter for engaging a receptacle of the excavator upper body. Typically, the receptacle would accept an excavator boom. The adaptor and the receptacle are fixedly secured together such that the adaptor defines a connector for receiving the crane boom in the same manner as the crane boom would be accepted by a crane body for providing a range of boom angles comparable to the range of boom angles available to the boom connected to the crane body. The method for adapting an excavator for use as a crane is provided. Typically, the excavator includes a lower crawler, an upper body and a receptacle secured to the upper body for receiving an excavation boom associated with an excavation implement. A crane boom associated with a crane implement is also utilized in the method. The method starts with disengaging, if connected, the excavator boom from the receptacle. Then, the adaptor is engaged with the receptacle secured to the upper excavator body. The adaptor defines a connector for receiving the crane boom in the same manner as the crane boom would be accepted by a crane body, in other words, providing a range of boom angles comparable to the range of boom angles available to the boom connected to the crane body. The crane boom is engaged with the connector.

6 Claims, 20 Drawing Sheets

CONVERSION APPARATUS AND METHOD FOR USE WITH EXCAVATOR AND CRANE DEVICES

FIELD OF THE INVENTION

The present invention relates generally to a conversion apparatus and method for use with excavator and crane devices. More particularly, the present invention relates to a mobile apparatus adaptable for use as a crane and as an excavator, and associated methods.

BACKGROUND OF THE INVENTION

Heavy duty earth moving and material handling equipment is very expensive. Each piece of equipment can represent a significant investment to accomplish a very specific or limited utility with respect to the piece of equipment. The industry has recognized the need to have such expensive equipment serve more general or at lease multiple applications. An example is the familiar back-hoe device having loader arms on one end mounted with a digging bucket or scraper, and a swiveling articulated boom at the other end mounted with a bucket, jack hammer or another material handling device. For example, the industry has taken the familiar back-hoe device and adapted it to new applications to increase their utility. U.S. Pat. No. 4,175,902 to Heroz, et al. is an example of such a novel adaptation of a familiar tool to achieve new utility. Other novel adaptations which increase the scope of application of existing equipment are beneficial to the industry. A device is needed for mounting different booms, e.g., a crane boom or an excavator boom, to the same platform.

It is, therefore, a feature of the present invention to provide a conversion apparatus and method for use with excavator and crane devices for mounting different booms to the same platform.

A feature of the present invention is to provide a conversion apparatus and method for use with excavator and crane devices that uses an excavator lower crawler and an excavator upper to be a crane.

Another feature of the present invention is to provide a conversion apparatus and method for use with excavator and crane devices that can accept either excavator implements or crane implements.

Yet another feature of the invention is to provide a conversion apparatus and method for use with excavator and crane devices that is stable when adapted to be used as a crane or as an excavator.

Still another feature of the present invention is providing a conversion apparatus and method for use with excavator and crane devices that provides a range of boom angles comparable to the range of boom angles available to the boom connected to the crane body.

Yet still another feature of the present invention is to provide a conversion apparatus and method for use with excavator and crane devices having the same operating and stability characteristics as a crane.

Yet further, an additional feature of the present invention is to provide a method for adapting an excavator for use as a crane.

Yet still further, an additional feature of the present invention is to provide a method for adapting various boom devices for use with nonconforming superstructure and crawler components.

Still further, an additional feature of the present invention is to provide a method for determining a luffing triangle effective to provide a full or near-full capacity crane.

Yet still further, an additional feature of the present invention is to provide an article of manufacture for adapting an excavator for use as a full or near-full capacity crane.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

To achieve the foregoing objects, features, and advantages and in accordance with the purpose of the invention as embodied and broadly described herein, a conversion apparatus and method for use with excavator and crane devices is provided.

A conversion apparatus for use with excavator and crane devices is provided for adapting an excavator for freely suspending a load above the ground. The crane includes a lower crawler adapted for use with an excavator, an upper body adapted for use with an excavator, a boom adapted to engage a crane body, and an adapter for engaging a receptacle of the excavator upper body. Typically, the receptacle would accept an excavator boom. The adaptor and the receptacle are fixedly secured together such that the adaptor defines a connector for receiving the crane boom in the same manner as the crane boom would be accepted by a crane body for providing a range of boom angles comparable to the range of boom angles available to the boom connected to the crane body.

In another embodiment, a conversion apparatus for use with excavator and crane devices is provided for adapting an excavator for freely suspending a load above the ground. The crane includes a lower crawler adapted for use with an excavator, an upper body adapted for use with an excavator, a boom adapted to engage a crane body, and an adapter for engaging a receptacle of the excavator upper body. The lower excavator crawler includes a first swivel at a position remote from the ground and a continuous belt drive track for mobilizing the crane-excavator apparatus over the ground. The upper excavator body includes a support member for providing structural integrity for the upper body, a second swivel at a position proximate to the ground, and a receptacle adapted to accept an excavator boom. The second swivel is rotatably engaged with the first swivel of the lower excavator crawler for providing rotation of the upper excavator body upon the lower crawler when the lower crawler is stationary or mobilized. The crane boom includes a distal end having associated therewith at least one lifting device and a proximate end adapted to engage a crane body. Also provided is an adapter for engaging the receptacle of the excavator upper body as if the adaptor was the excavator boom. The adaptor and the receptacle are fixedly secured together such that the adaptor defines a connector. The connector is for receiving the crane boom in the same manner as the crane boom would be accepted by a crane body for providing a range of boom angles comparable to the range of boom angles available to the boom connected to a crane body.

In still another embodiment, a method for adapting an excavator for use as a crane is provided. Typically, the excavator includes a lower crawler, an upper body and a receptacle secured to the upper body for receiving an excavation boom associated with an excavation implement. A crane boom associated with a crane implement is also utilized in the method. The method starts with disengaging, if connected, the excavator boom from the receptacle. Then, the adaptor is engaged with the receptacle secured to the upper excavator body. The adaptor defines a connector for receiving the crane boom in the same manner as the crane boom would be accepted by a crane body, in other words, providing a range of boom angles comparable to the range of boom angles available to the boom connected to the crane body. The crane boom is engaged with the connector. Then the crane boom is articulated with respect to the connector in such a manner as to provide an excavator-crane apparatus having the same operating and stability characteristics as a crane.

In another embodiment a method is provided for determining a luffing triangle effective to provide a full or near-full capacity crane. The crane has a boom with a foot, a cylinder and a frame. The luffing triangle method comprises the steps of locating a boom foot position on the frame, locating a cylinder frame position on the frame such that the boom foot position and the cylinder frame position are required to be adequately spaced to provide a base for supporting the desired crane capacity, and locating a boom/cylinder position with respect to the boom foot position and the cylinder frame position such that a sufficient range of motion is provided and a sufficient leverage is provided for the desired crane capacity.

In yet still another embodiment, an article of manufacture is provided for adapting an excavator for use as a full or near-full capacity crane. The excavator comprises a lower crawler, an upper body and a receptacle secured to the upper body for receiving an excavation boom associated with an excavation implement, a cylinder and a crane boom with a foot associated with a crane implement. The article comprising a body member. The body member having a boom foot securing device for engaging the frame, a cylinder frame securing device for engaging the frame such that the boom foot securing device and the cylinder frame securing device are required to be adequately spaced to provide a base for supporting the desired crane capacity, and a boom/cylinder securing device with respect to the boom foot securing device and the cylinder frame securing device such that a sufficient range of motion is provided and a sufficient leverage is provided for the desired crane capacity.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

Figure 1A:
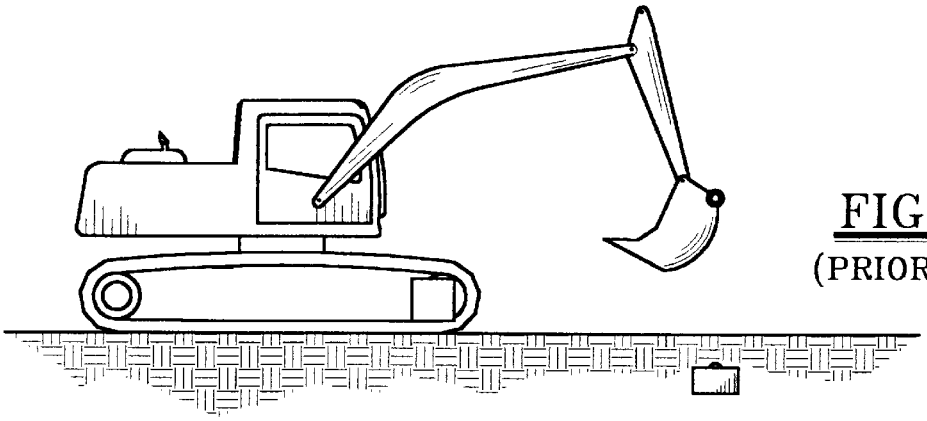
FIG.1A (PRIOR ART)
FIGS. 1A and 1B are illustrations of conventional excavator devices.
Figure 1B:
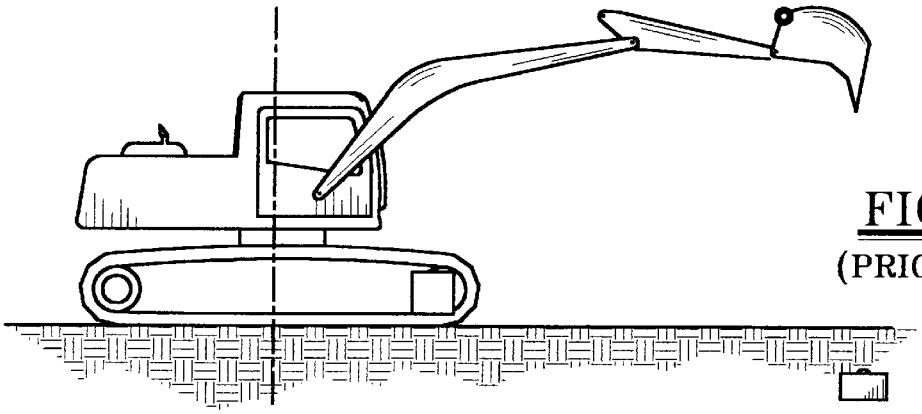
FIG.1B (PRIOR ART)
Figure 2A:
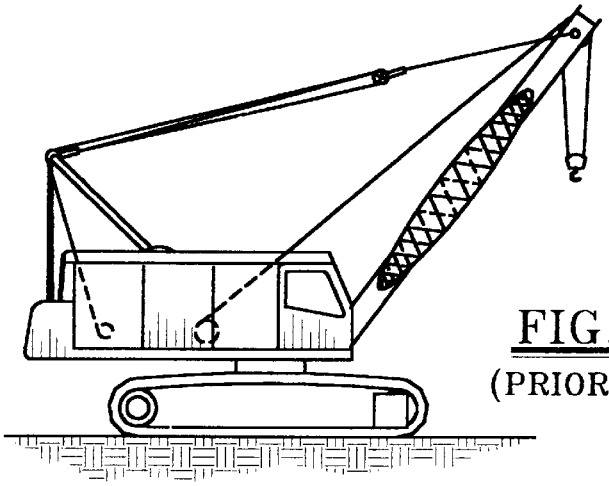
FIG.2A (PRIOR ART)
FIGS. 2A and 2B are illustrations of conventional crane devices.
Figure 2B:
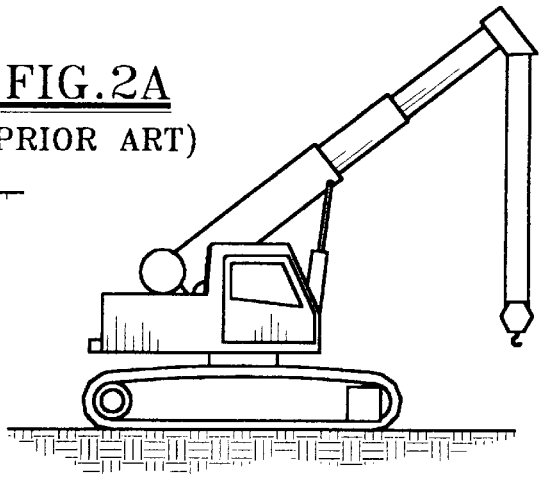
FIG.2B (PRIOR ART)

FIGS. 1A, 1B and 1C are illustrations of a conventional excavator apparatus as known in the art. The conventional excavator apparatus has a lower crawler 100, an upper body 200 and an implement. The implement is typically driven by hydraulic means. FIG. 2 is an illustration of a conventional crane apparatus as known in the art.

Figure 3:
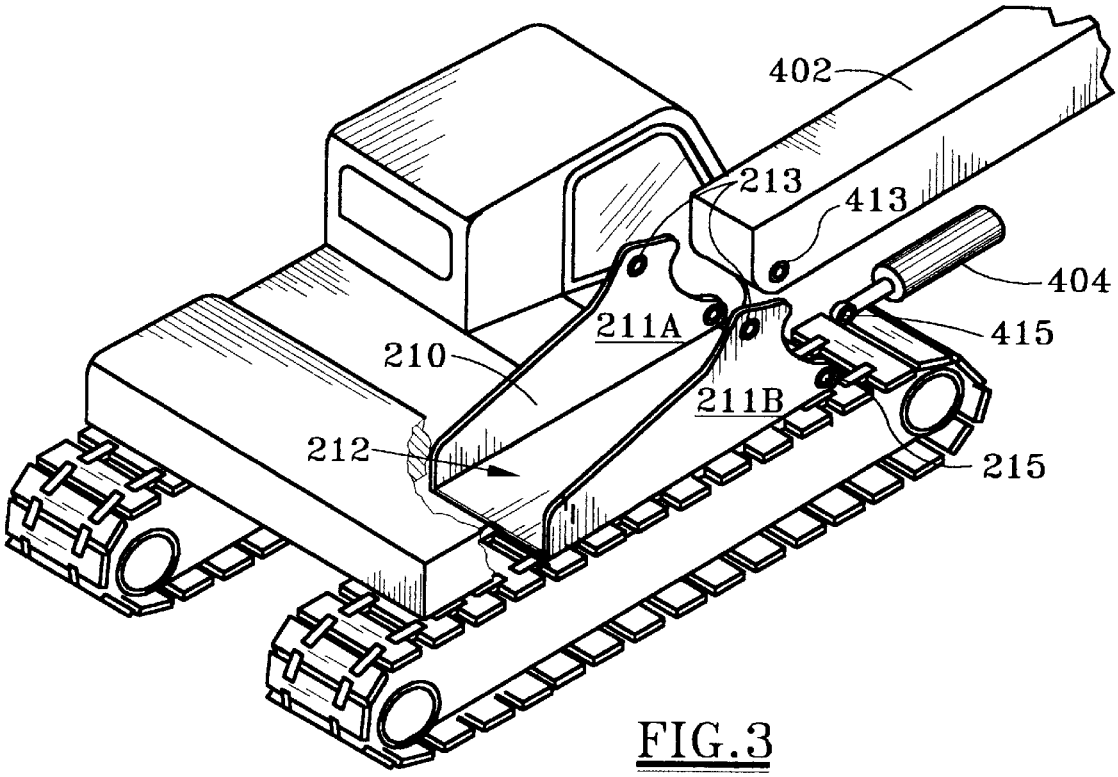
FIG. 3 is a perspective view illustrating the relationship between the boom and the upper body of a typical crane or excavator apparatus.

FIG. 3 is a perspective view illustrating the relationship between an implement and an upper body of a typical crane or excavator apparatus. The arm 402 of the implement is positioned to be removably engaged with a receptacle 210. The arm 402 has one or more securing devices 413. The receptacle 210 comprises parallel members 211A, 211B. The parallel members 211A, 211B form a channel 212. The parallel members 211A, 211B have at an end thereof one or more securing devices 213, 215. The implement comprises the arm 402 having one or more securing devices 413 and a hydraulic cylinder 404 operatively associated with the arm 402. The hydraulic cylinder 404 has associated there with a securing device 415. The arm 402 of the implement is engaged in the channel 212 of the receptacle 210. The securing devices 413 of the arm 402 are engaged with the securing devices 213 of the receptacle 210. Further, the securing device 415 associated with the hydraulic cylinder 404 is engaged with the securing device 215 of the receptacle 210. The arm 402 is thereafter engaged in the channel 212 defined by the parallel members 211A, 211B of the receptacle 210. The receptacle securing device 213 is in pivotal channeled relationship with the arm securing device 413 such that as the hydraulic cylinder 404 is expanded, the arm 404 rotates about the axis defined by the securing devices 213, 214.

Figure 4:
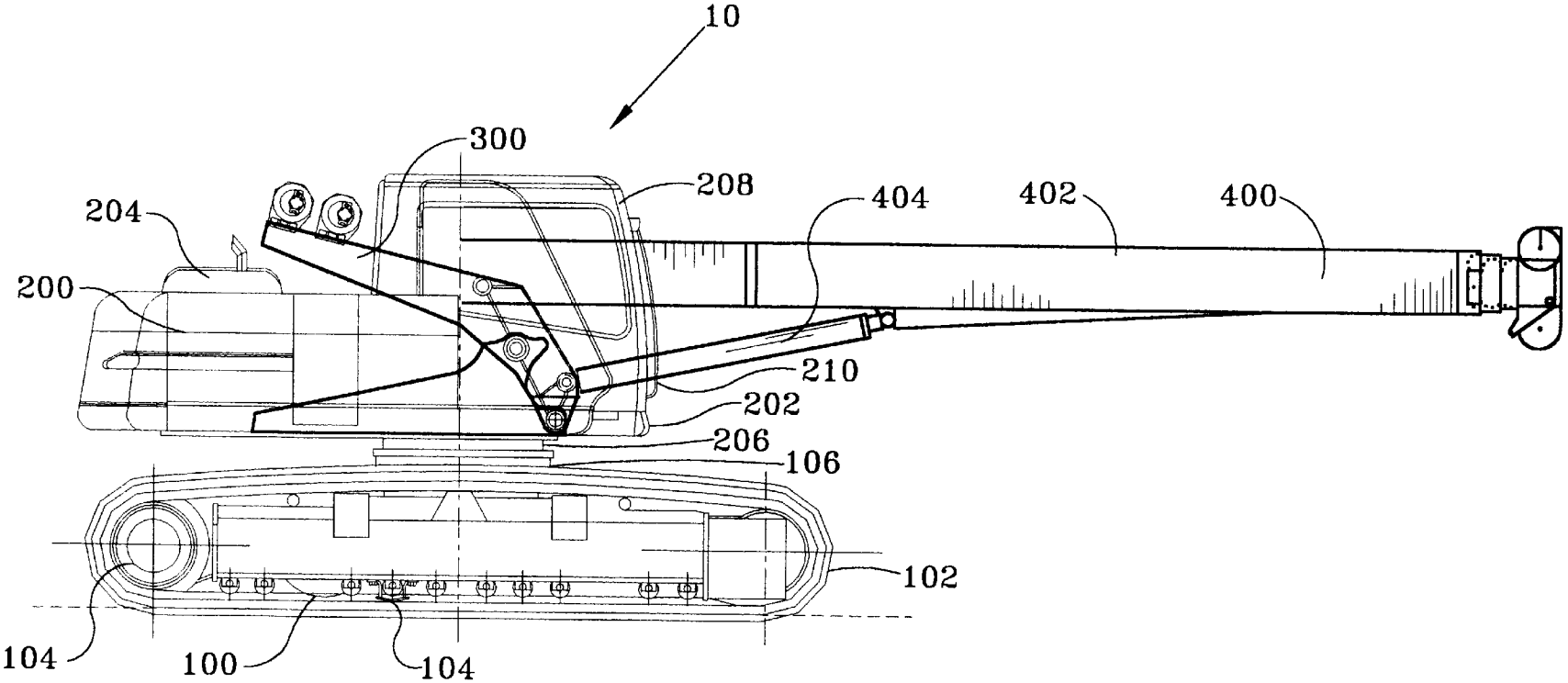
FIG. 4 is a perspective view of a preferred embodiment of a crane-excavator apparatus as practiced by the present invention with the boom parallel with the ground.

FIG. 4 is a perspective view of the preferred embodiment of the crane-excavator apparatus 10 as practice by the present invention with a boom 400 parallel to the ground. The crane-excavator apparatus 10 comprises a lower crawler 100, an upper body 200, an adapter 300 and the boom 400. The lower crawler 100 comprises a continuous belt 102 of typically metal plates and a plurality of guides 104 associated with the continuous belt 102. The lower crawler 100 also has a swivel 106 for operatively associating with the upper body 200. The upper body 200 comprises a support member 202, a power unit 204, a swivel 206, a cab 208 and a receptacle 210. The swivel 206 of the upper body 200 is movably associated with the swivel 106 of the lower crawler 100. The boom 400 comprises an arm 402 and a hydraulic cylinder 404. It is appreciated by those skilled in the art that excavators and cranes have distinct features. For example, the boom 400 may readily have one or more lifting devices associated with its distal end including, without limitation, a sheave, a hook, an auxiliary hook, a main block, an auxiliary block, a whip line, a fast line, etc.

Figure 5:
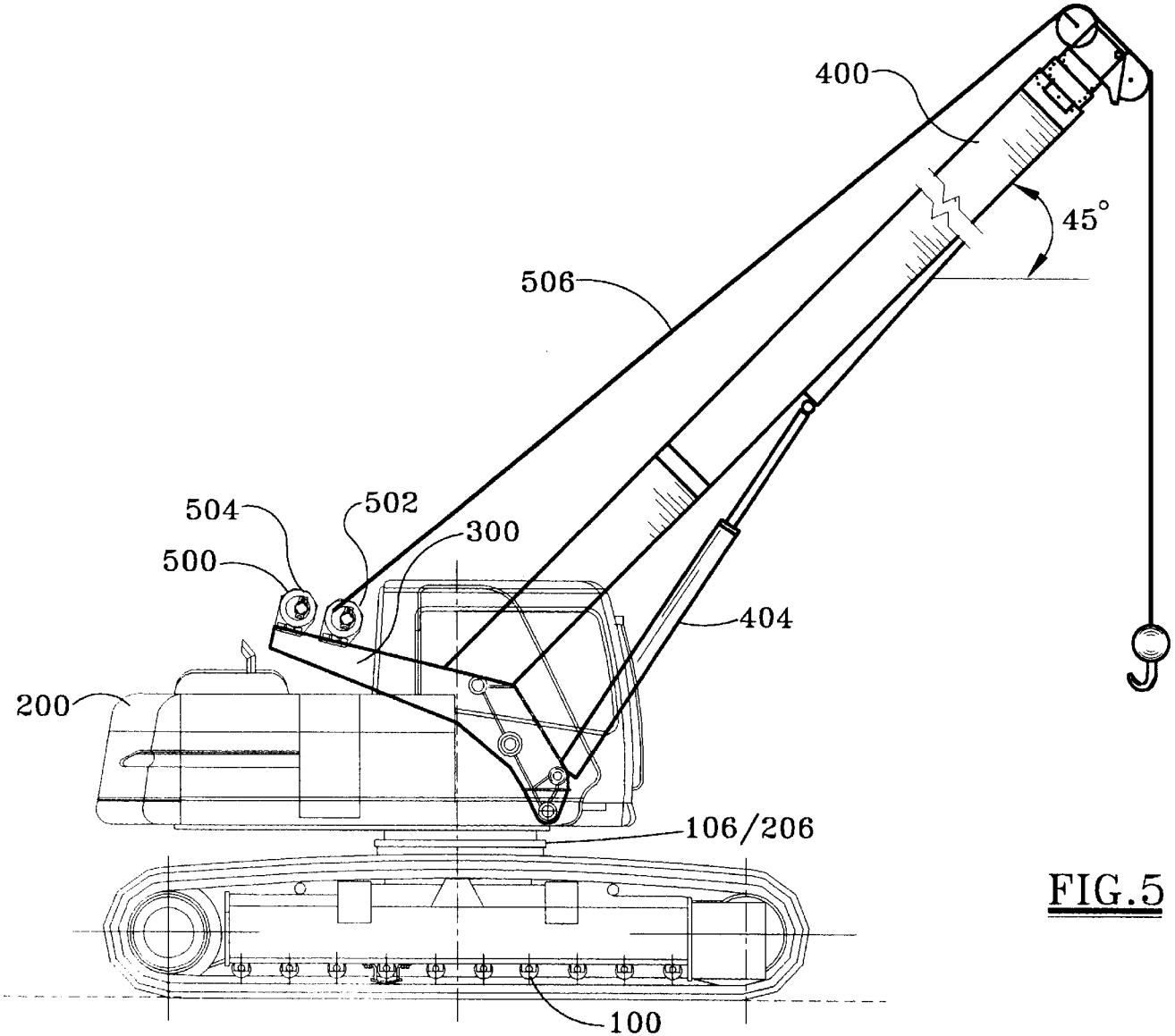
FIG. 5 is a perspective view of the preferred embodiment of the crane-excavator apparatus of the present invention as illustrated in FIG. 4 with the boom at an angle with the ground.

FIG. 5 is perspective view of the preferred embodiment of the crane-excavator apparatus 10 of the present invention as illustrated in FIG. 4 with the boom 400 at an angel with the ground. The boom 400 is illustrated with the hydraulic cylinder 404 extended such that the boom 400 is at an angle with the ground. The lower crawler 100, in association with the swivels 106, 206, supports the upper body 200. The crane-excavator apparatus 10 is illustrated with one or more hoist 500. More particularly, a first hoist 502 and a second hoist 504 are provided. It can be appreciated that multiple hoist for multiple purposes can be readily adapted for use of the present invention. The first hoist 502 is illustrated having a line 506 disposed along the top of the boom 400.

Figure 6:
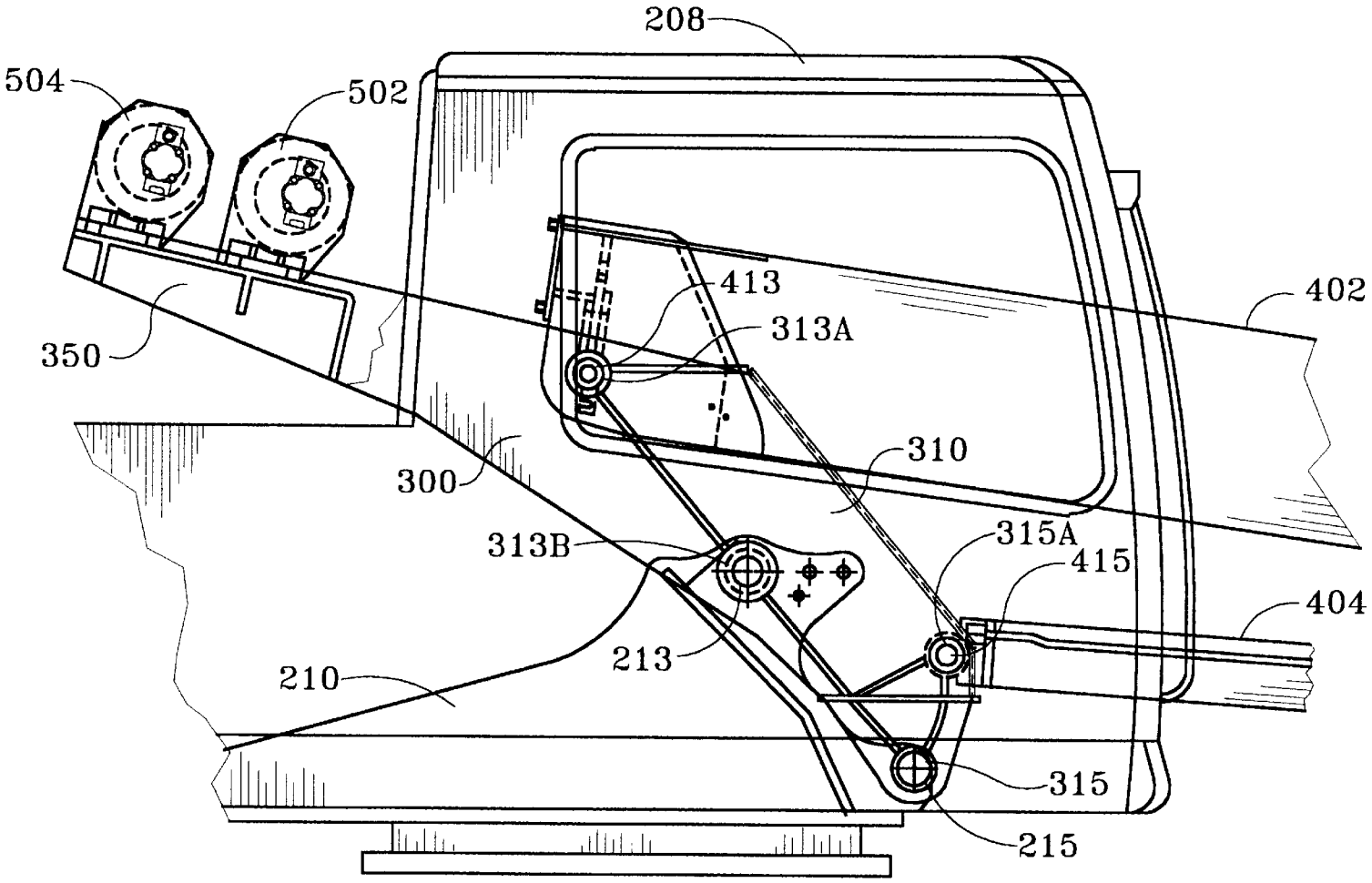
FIG. 6 is a elevation view illustrating the relationship between the boom, the upper body and the adaptor used in the preferred embodiment of the crane-excavator apparatus of the present invention as illustrated in FIG. 4.

FIG. 6 is an elevation view illustrating the relationship between the boom 400, the upper body 200 and the adapter 300 used in the preferred embodiment of the crane-excavator apparatus 10 of the present invention as illustrated in FIG. 4. The receptacle 210 is operatively associated with the adapter 300, which in term is operatively associated with the boom 400. Particularly, the securing device 213 of the receptacle 210 is secured with the securing device 313B of the adapter 300. Similarly, the securing device 215 of the receptacle 210 is secured with the securing device 315B of the adapter 300. The respective securing devices 213, 213B, 215, 215B are secured in such a manner as to provide a fix relationship between the receptacle 210 and the adapter 300. The arm 402 of the boom 400 is secured to the adapter 300 using the boom securing device 413 and the adapter securing device 313A. Similarly, the hydraulic cylinder 404 is secured to the adapter 300 using the adapter securing device 315A and the cylinder securing device 415. The relationship between the boom 400 and the adapter 300 provides for a pivoting engagement about the boom and adapter securing devices 413, 313A. Similarly, the relationship between the hydraulic cylinder 404 and the adapter 300 is such that the cylinder 404 pivots about the adapter securing device 315A and the cylinder securing device 415. Thus, the receptacle 210 and the adapter 300 are removable secured yet in a fixed positional relationship when the crane-excavator apparatus 10 is operating as a crane. Alternately, the relationship between adapter 300, on one hand, and the boom 400 and cylinder 404, on the other hand, provides a pivotaly rotating relationship about the respective securing devices 413, 313A, 415, 315A.

Figure 7:
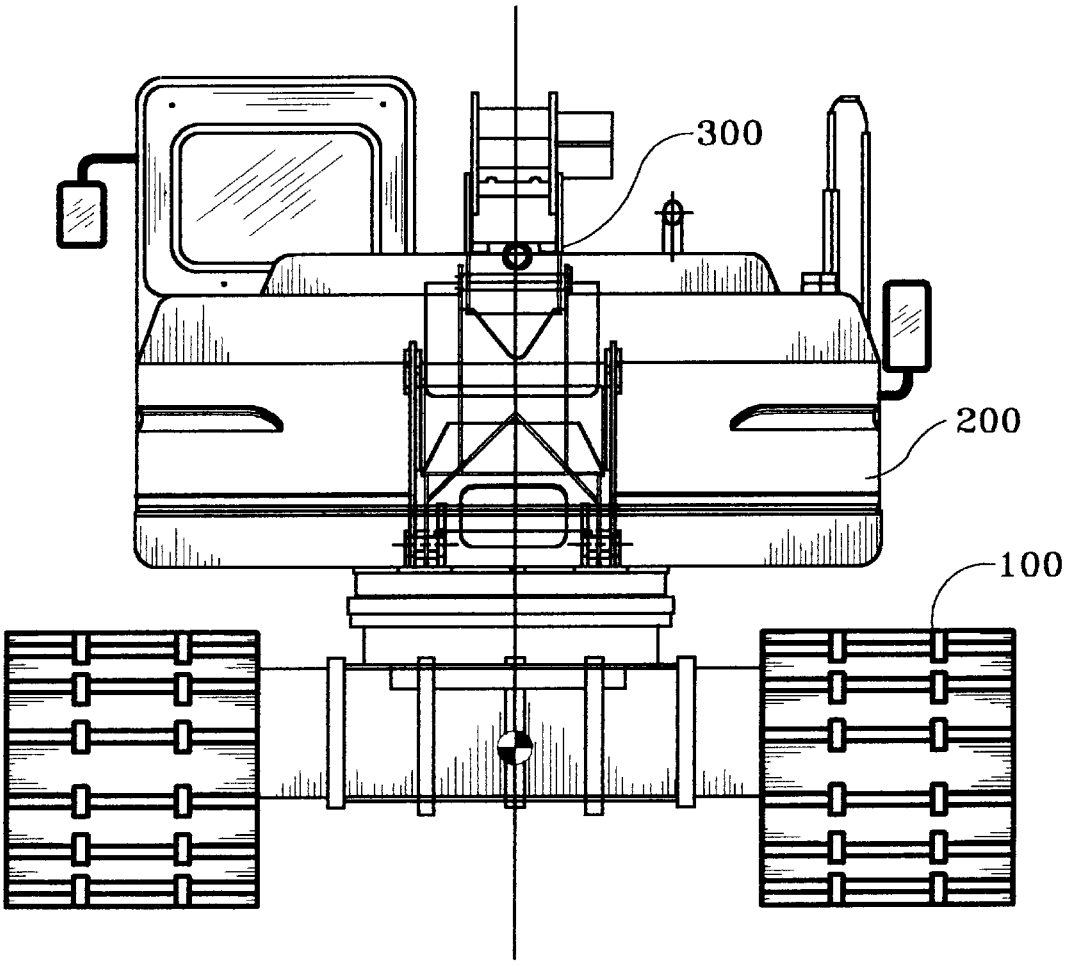
FIG. 7 is an end view illustrating the relationship between the lower crawler, the upper body and the adaptor used in the preferred embodiment of the crane-excavator apparatus of the present invention as illustrated in FIG. 4.

FIG. 7 is an end view illustrating the relationship between the lower crawler 100, the upper body 200 and the adapter 300 used in the preferred embodiment of the crane-excavator apparatus 10 of the present invention as illustrated in FIG. 4. The crane-excavator apparatus 10 is configured to centrally located the load-bearing forces associated with the crane-excavator apparatus 10. Thus, a standard excavator apparatus is readily adapted to a stable, functional crane apparatus by using the present invention.

Figure 8:
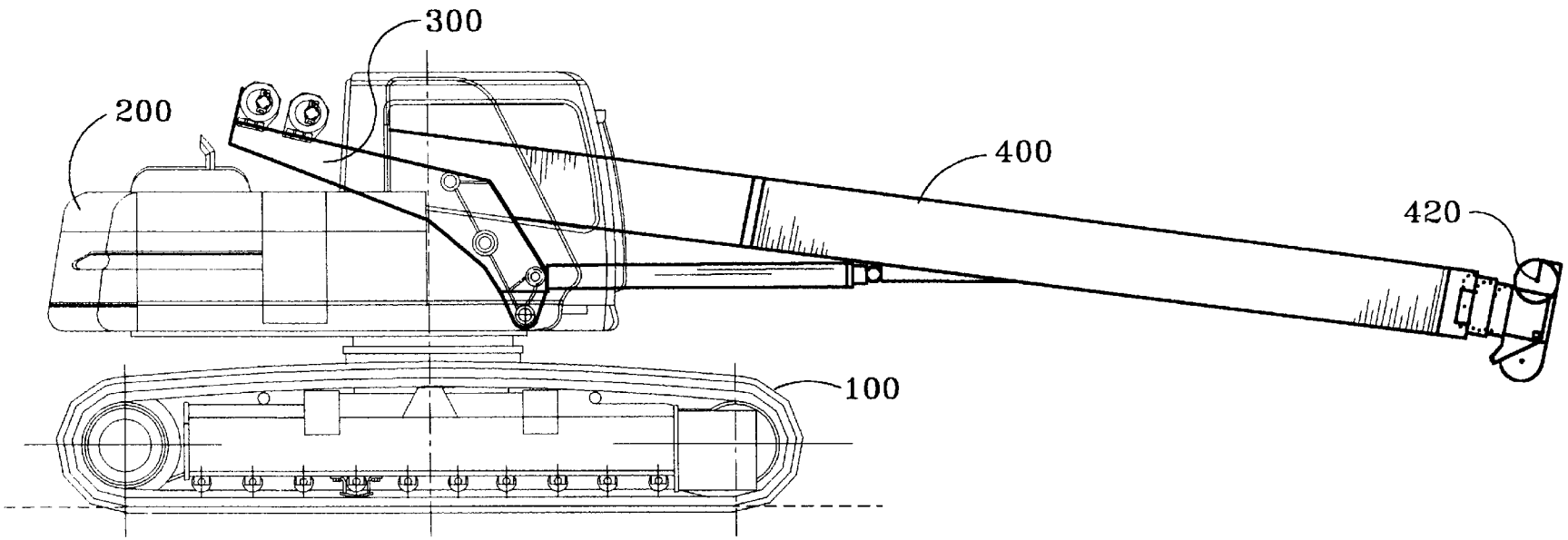
FIG. 8 is a perspective view of the preferred embodiment of the crane-excavator apparatus of the present invention as illustrated in FIG. 4 with the boom at an angle with the ground illustrating the sheave.

FIG. 8 is a perspective view of the preferred embodiment of the crane-excavator apparatus 10 of the present invention as illustrated in FIG. 4 with the boom at an angel with the ground illustrating a sheave 420. The lower crawler 100 is positioned on the upper body 200 such that the boom 400 is in a lowered, angled relationship with the ground. The adapter 300 is fixed with respect to the upper body 200 and the boom 400 in a lower angled relationship is illustrated.

Figure 9:
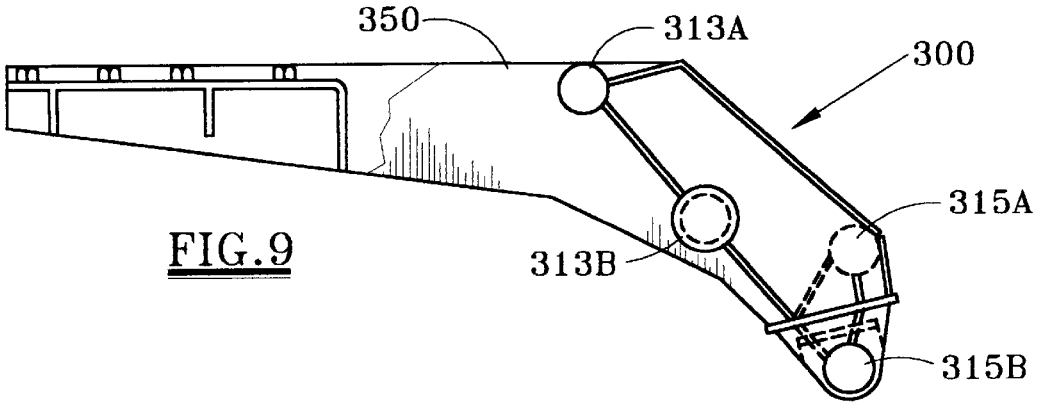
FIG. 9 is a side view illustrating the adaptor used in the preferred embodiment of the crane-excavator apparatus of the present invention illustrated in FIG. 4.

FIG. 9 is a side view illustrating the adaptor used in the preferred embodiment of the crane-excavator apparatus of the present invention illustrated in FIG. 4. The adapter 300 is illustrated in FIG. 9 having a pedestal 350. The first fixed securing device 315A and the second fixed securing device 315B are illustrated at one end of the adapter 300. At the other end of the adapter 300 is the pedestal 350. Located at an intermediate location are the first offset securing device 315A and the second offset securing device 313B.

Figure 10:
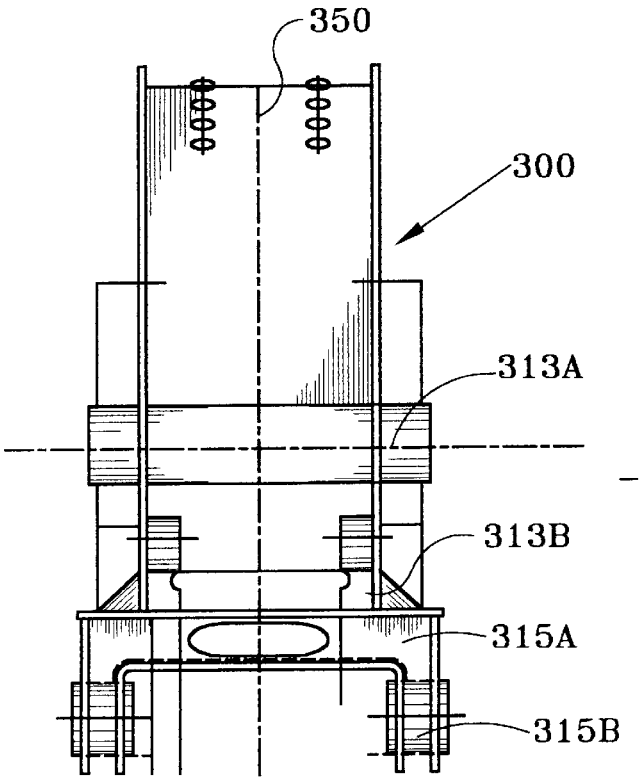
FIG. 10 is a plan view illustrating the adaptor used in the preferred embodiment of the crane-excavator apparatus of the present invention illustrated in FIG. 4.

FIG. 10 is a plan view illustrating the adaptor used in the preferred embodiment of the crane-excavator apparatus of the present invention illustrated in FIG. 4. The vertical relationship of the various components of the adapter 300 are illustrated in FIG. 10. Particularly, the relationship of the pedestal 350, the first offset securing device 313A, the second offset securing device 313B, the first fixed securing device 315A and the second fixed securing device 315B are illustrated in respective vertical positions.

Figure 11:
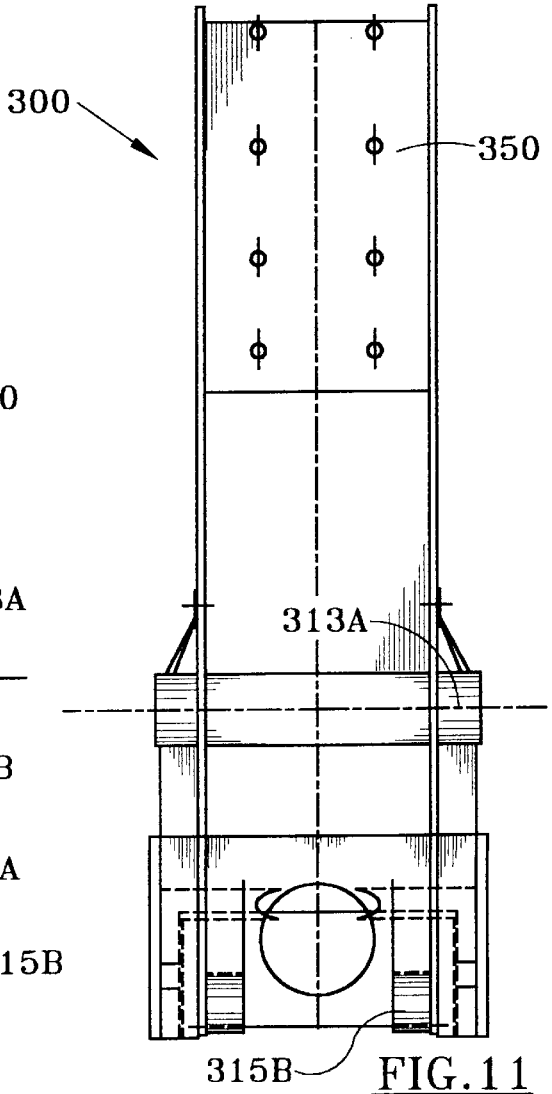
FIG. 11 is a plan view illustrating the relationship between the boom, a portion of the upper body and the adaptor used in the preferred embodiment of the crane-excavator apparatus of the present invention as illustrated in FIG. 4.

FIG. 11 is a plan view illustrating the relationship between the boom, a portion of the upper body and the adaptor used in the preferred embodiment of the crane-excavator apparatus of the present invention as illustrated in FIG. 4. The respective positions of the offset securing devices 313A, 313B and the fixed securing devices 315A, 315B are illustrated being disposed at one end of the adapter 300 with the pedestal 350 located remote there from.

Figure 12:
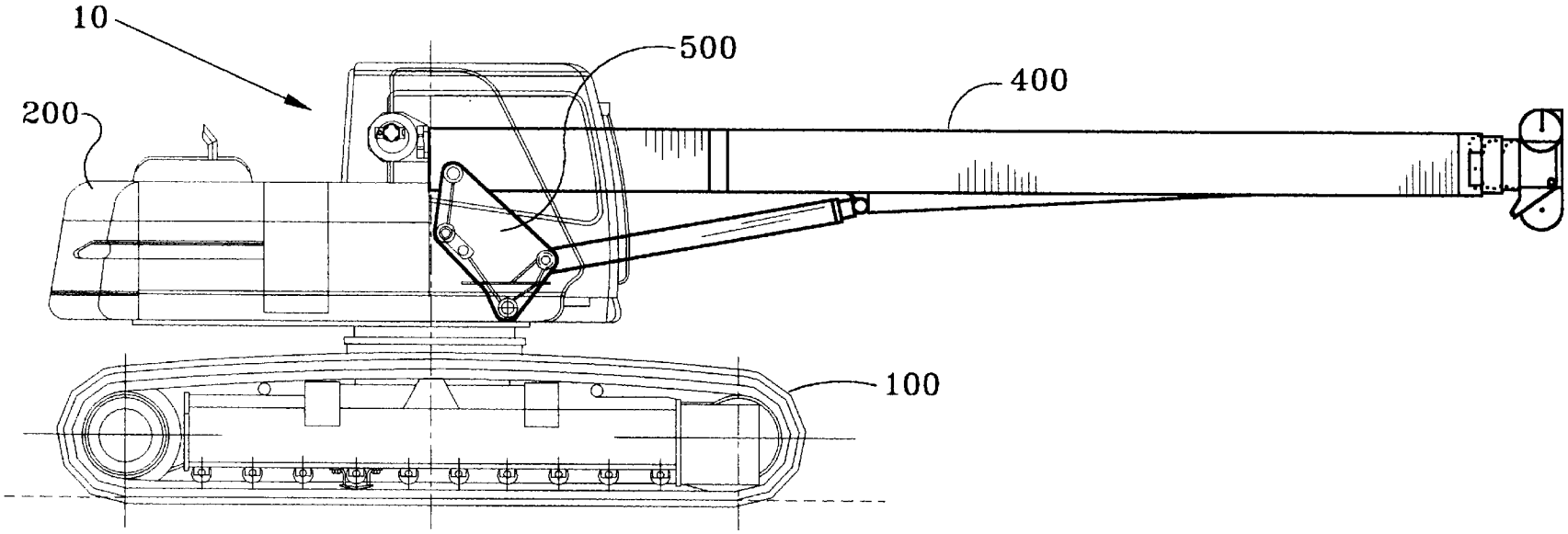
FIG. 12 is a perspective view of another preferred embodiment of a crane-excavator apparatus as practiced by the present invention with the boom parallel with the ground.

FIG. 12 is a perspective view of another preferred embodiment of a crane-excavator apparatus 10 as practiced by the present invention with the boom parallel to the ground. The crane-excavator apparatus 10 includes a lower crawler 100, an upper body 200, an alternate adapter 500 and a boom 400.

Figure 13:
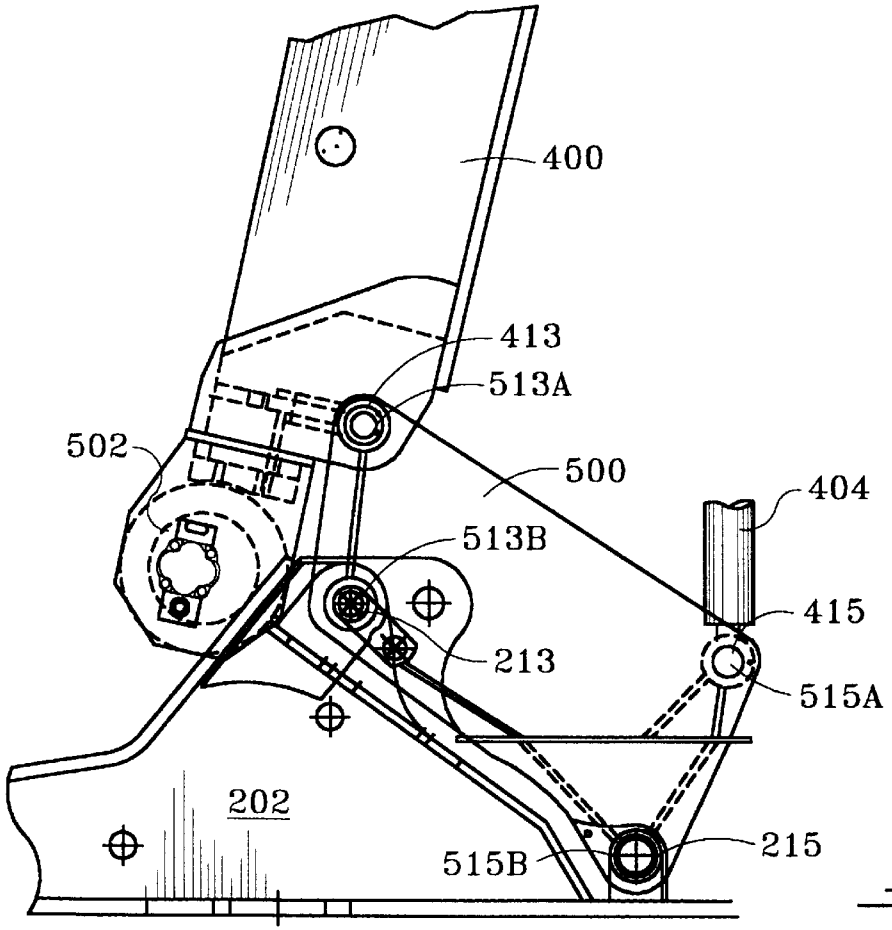
FIG. 13 is a elevation view illustrating the relationship between the boom, a portion of the upper body and the adaptor used in the preferred embodiment of the crane-excavator apparatus of the present invention as illustrated in FIG. 12.

FIG. 13 is an elevation view illustrating the relationship between the boom 400, the receptacle 202 of the upper body 200 and the adapter 500 used in the preferred embodiment of the crane-excavator apparatus 10 of the present invention as illustrated in FIG. 9. The receptacle 202 comprises the securing device 213 and the securing device 215. The boom 400 is provided with a hoist 502 attached to the proximal end thereof.

The adapter 500 is configured to movably accept the boom 400 and the hydraulic cylinder 404. Also, the adapter 500 is provided for being secured to the receptacle 202. The boom 400 is pivotaly connected to the adapter 500 by the boom securing device 413 and the adapter securing device 513A. Similarly, the hydraulic cylinder 404 is pivotaly engaged with the adapter 500 by the adapter securing device 515A and the cylinder securing device 415. Since the boom 400 and hydraulic cylinder 404 are in pivotal communication with the adapter 500, as the hydraulic cylinder 404 expands and contracts, the boom 400 and the hydraulic cylinder 404 pivot in unison with respect to the adapter 500. The adapter 500 is fixedly secured to the receptacle securing device 213 and the adapter securing device 513B, on one side, and the receptacle securing 215 and the adapter securing device 515B, on the other side.

Figure 14:
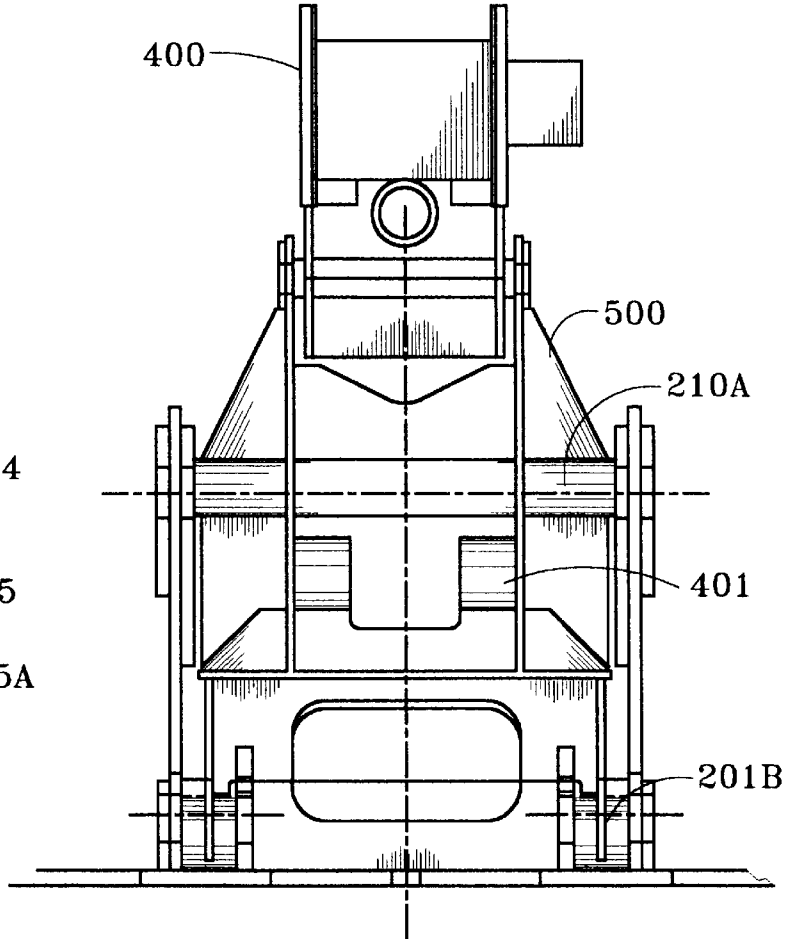
FIG. 14 is a plan view illustrating the relationship between the boom, a portion of the upper body and the adaptor used in the preferred embodiment of the crane-excavator apparatus of the present invention as illustrated in FIG. 12.

FIG. 14 is a plan view illustrating the relationship between the boom 400, the receptacle 202 and the adapter 500 as used in the preferred embodiment of the crane-excavator apparatus 10 of the present invention as illustrated in FIG. 12. The boom 400 is illustrated attached to the adapter 500 via an adapter/crane pin 401. The adapter 500 is attached to the receptacle 202 via a first receptacle/adapter pin 201B. The hydraulic cylinder 404 is attached to the adapter 500 via the cylinder/adapter pin 401. It can be appreciated by one skilled in the art to be able to configure or reconfigure the adapters as described herein so as to be different, yet within the scope of, the present invention.

Figure 15:
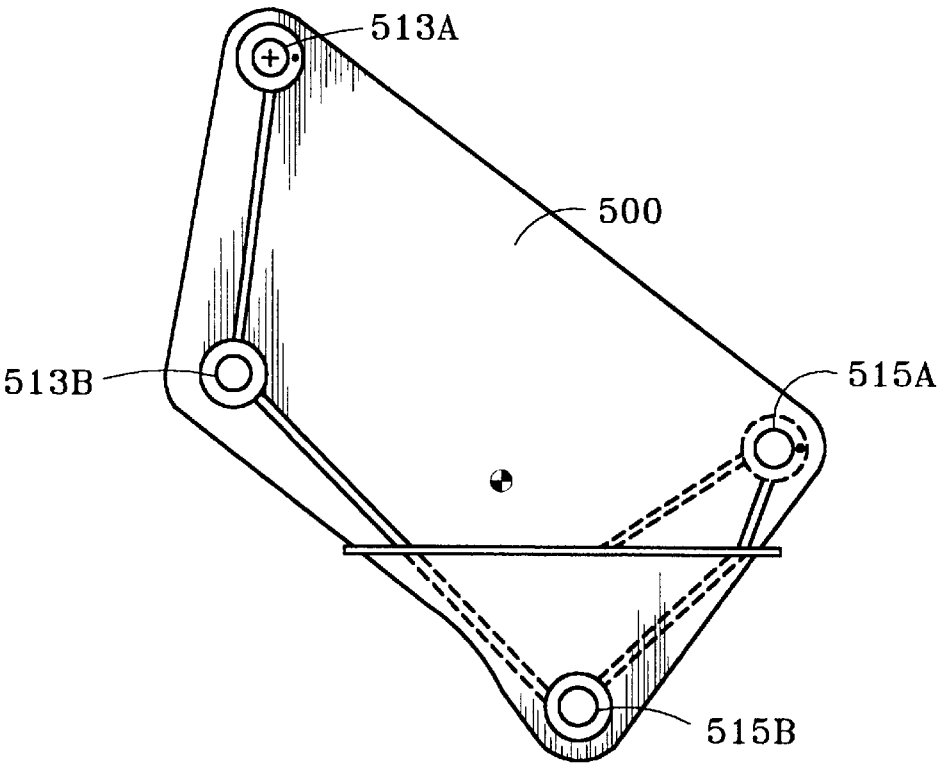
FIG. 15 is a side view illustrating the adaptor used in the preferred embodiment of the crane-excavator apparatus of the present invention illustrated in FIG. 12.

FIG. 15 is a side view illustrating the adapter 500 used in an alternate preferred embodiment of the crane-excavator apparatus 10 of the present invention as illustrated in FIG. 12. The adapter 500 has a securing device 513 for pivotaly engaging the boom 400, and a securing device 515A for pivotaly engaging the hydraulic cylinder 404. Also, the adapter 500 has two or more securing devices 513B, 515B for fixedly securing the adapter 500 to the receptacle 202.

Figure 16:
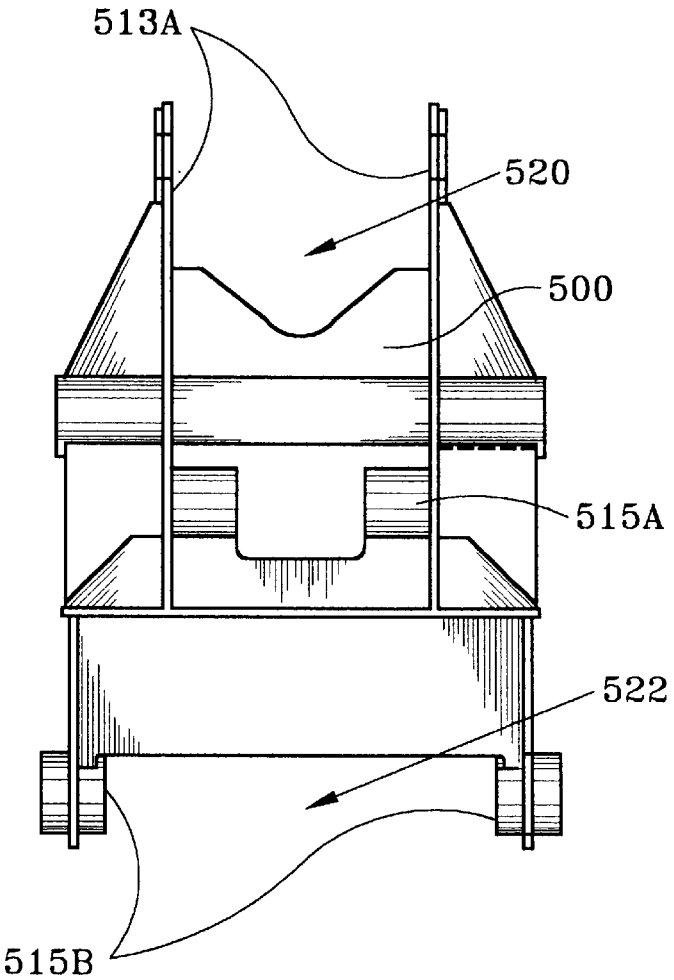
FIG. 16 is a plan view illustrating the adaptor used in the preferred embodiment of the crane-excavator apparatus of the present invention illustrated in FIG. 12.

FIG. 16 is an plan view illustrating the adapter 500 used in the alternate preferred embodiment of the crane-excavator apparatus 10 of the present invention as illustrated in FIG. 12. The adapter 500 is configured such that the securing devices 513A and the body of the adapter 500 form a channel 520. The channel 520 is adapted for receiving the boom 400. In like manner, the securing devices 515B in association with the body of the adapter 500 are configured to form a channel 522. The channel 522 is adapted for receiving the receptacle 202. Similarly, the securing devices 515A are provided for forming a channel through which the hydraulic cylinder 404 pivotaly engages. The securing device 513B provides fixed engagement with receptacle 202.

Figure 17:
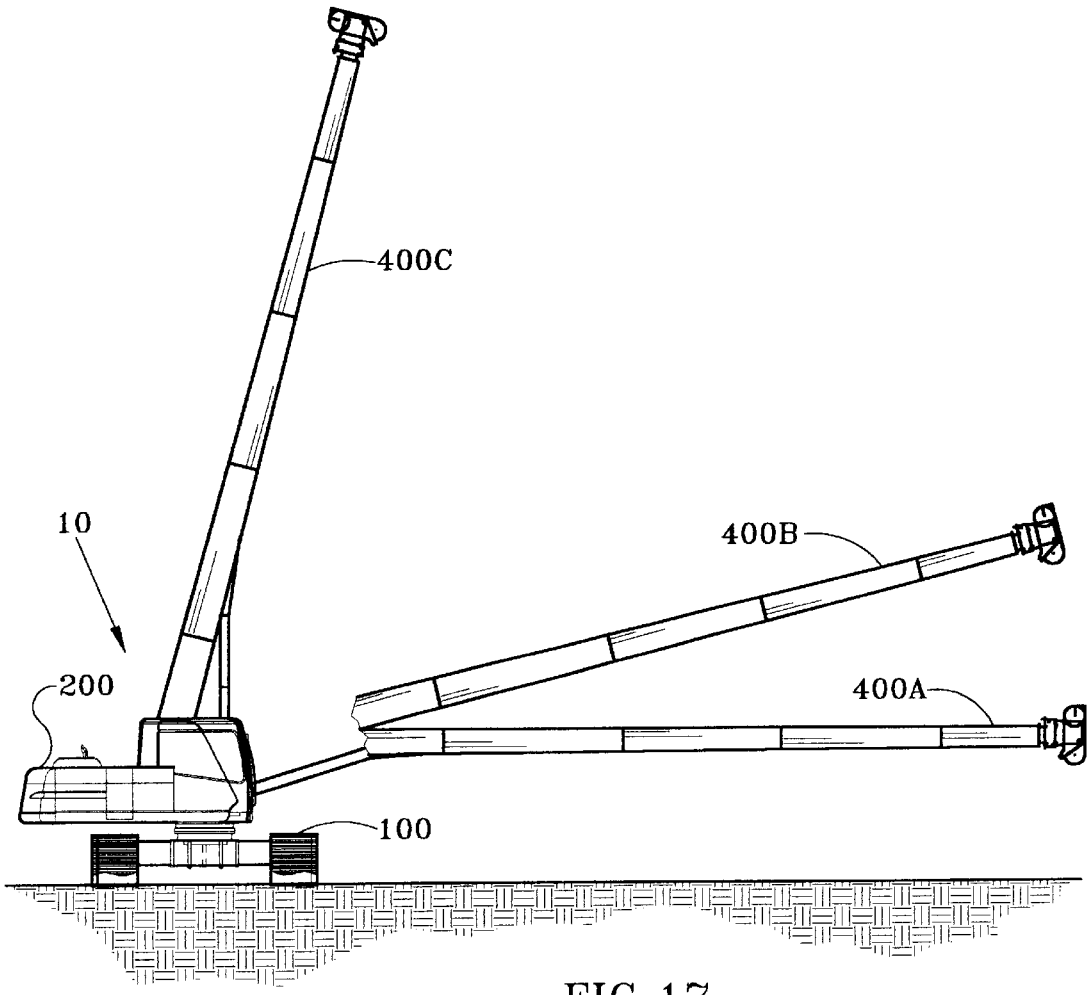
FIG. 17 is a view illustrating the scope of coverage of the boom of the crane-excavator apparatus of the present invention.

FIG. 17 is a view illustrating the scope of coverage of the boom of the crane-excavator apparatus of the present invention.

Figure 18:
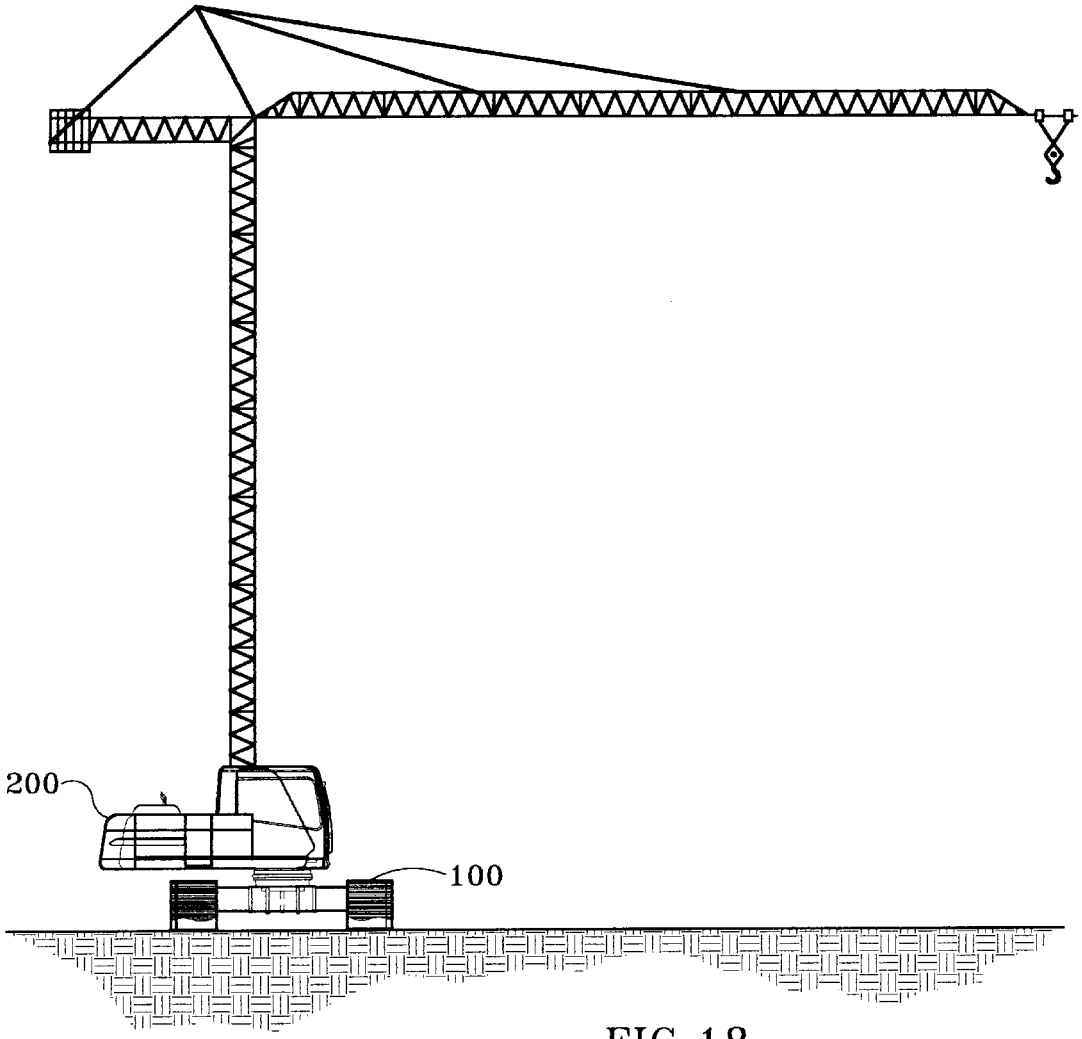
FIG. 18 is a view illustrating a modified lattice boom in operative association with the crane-excavator apparatus of the present invention.
Figure 19:
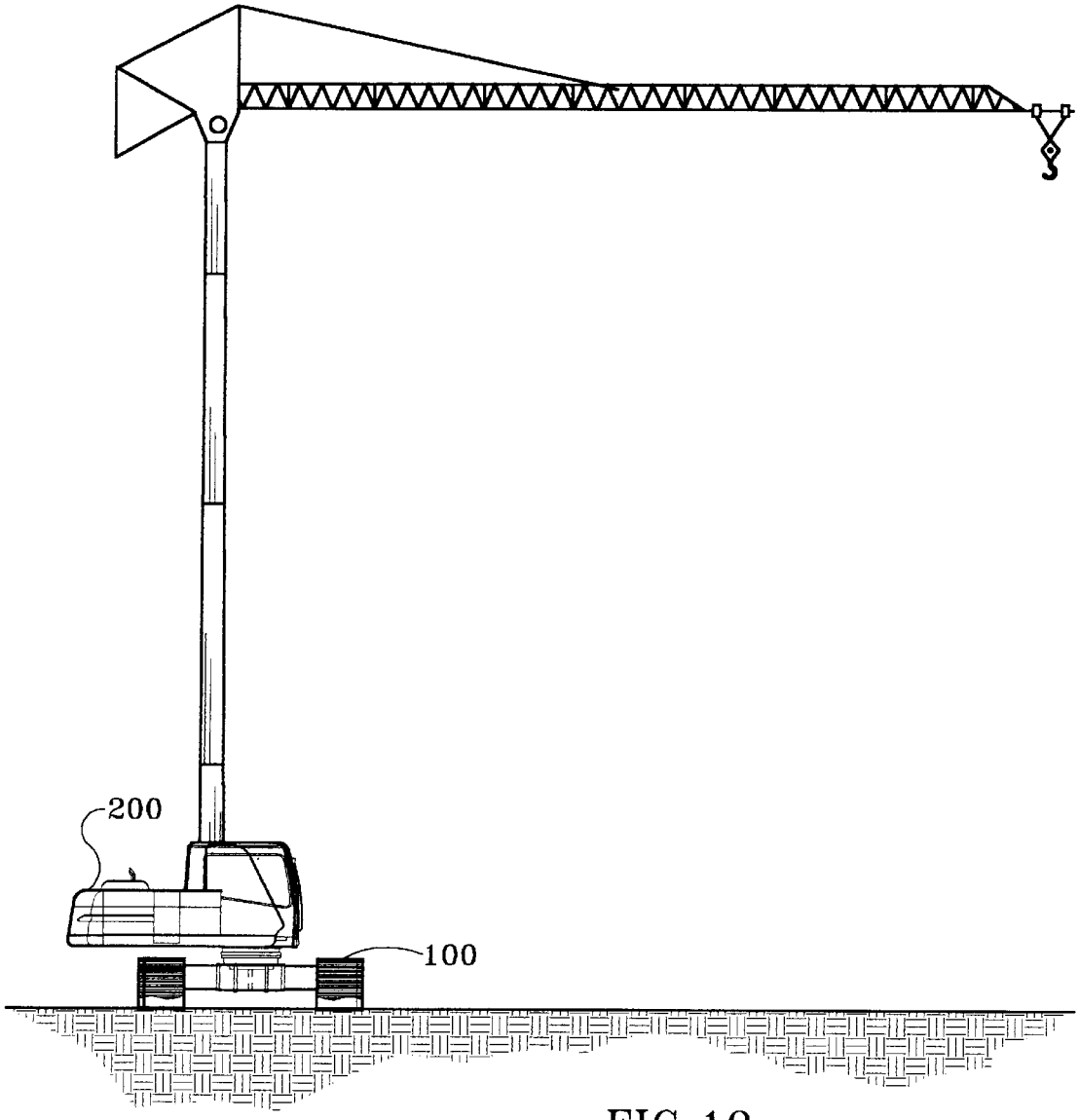
FIG. 19 is a view illustrating a modified telescopic-lattice boom in operative association with the crane-excavator apparatus of the present invention.

FIG. 18 is a view illustrating a modified lattice boom in operative association with the crane-excavator apparatus of the present invention. FIG. 19 is a view illustrating a modified telescopic-lattice boom in operative association with the crane-excavator apparatus of the present invention. The number and variations of the implements available for use with the conversion apparatus of the present invention are numerous and are limited only by the number of applications available.

Figure 20:
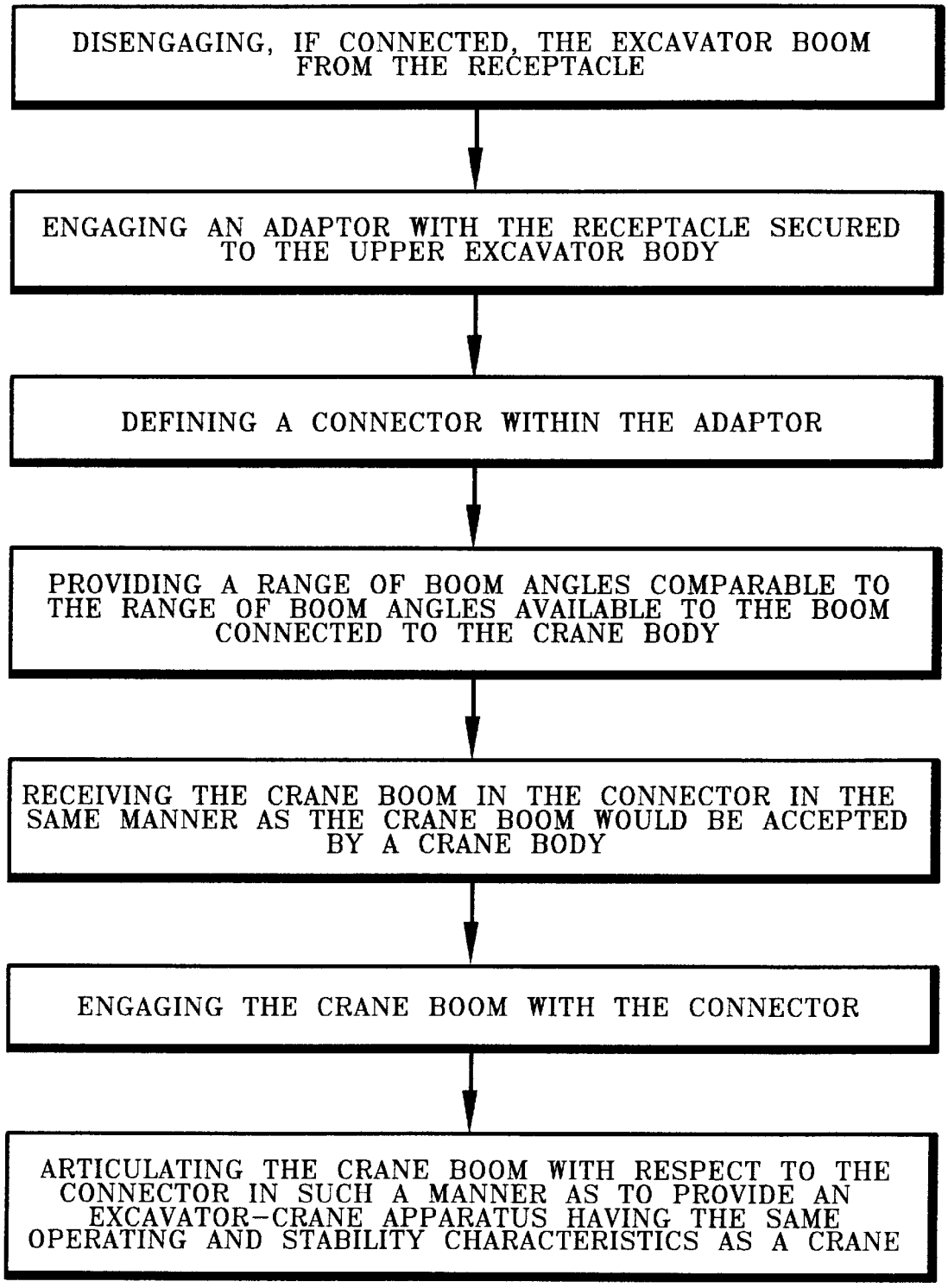
FIG. 20 is a flow chart illustrating a method associated with the crane-excavator of the present invention.

FIG. 20 is a flow chart illustrating the method associated with the crane-excavator of the present invention. Typically, the excavator includes a lower crawler, an upper body and a receptacle secured to the upper body for receiving an excavation boom associated with an excavation implement. A crane boom associated with a crane implement is also utilized in the method. The method starts with disengaging, if connected, the excavator boom from the receptacle. Then, the adaptor is engaged with the receptacle secured to the upper excavator body. The adaptor defines a connector for receiving the crane boom in the same manner as the crane boom would be accepted by a crane body, in other words, providing a range of boom angles comparable to the range of boom angles available to the boom connected to the crane body. The crane boom is engaged with the connector. Then the crane boom is articulated with respect to the connector in such a manner as to provide an excavator-crane apparatus having the same operating and stability characteristics as a crane.

Figure 21A:
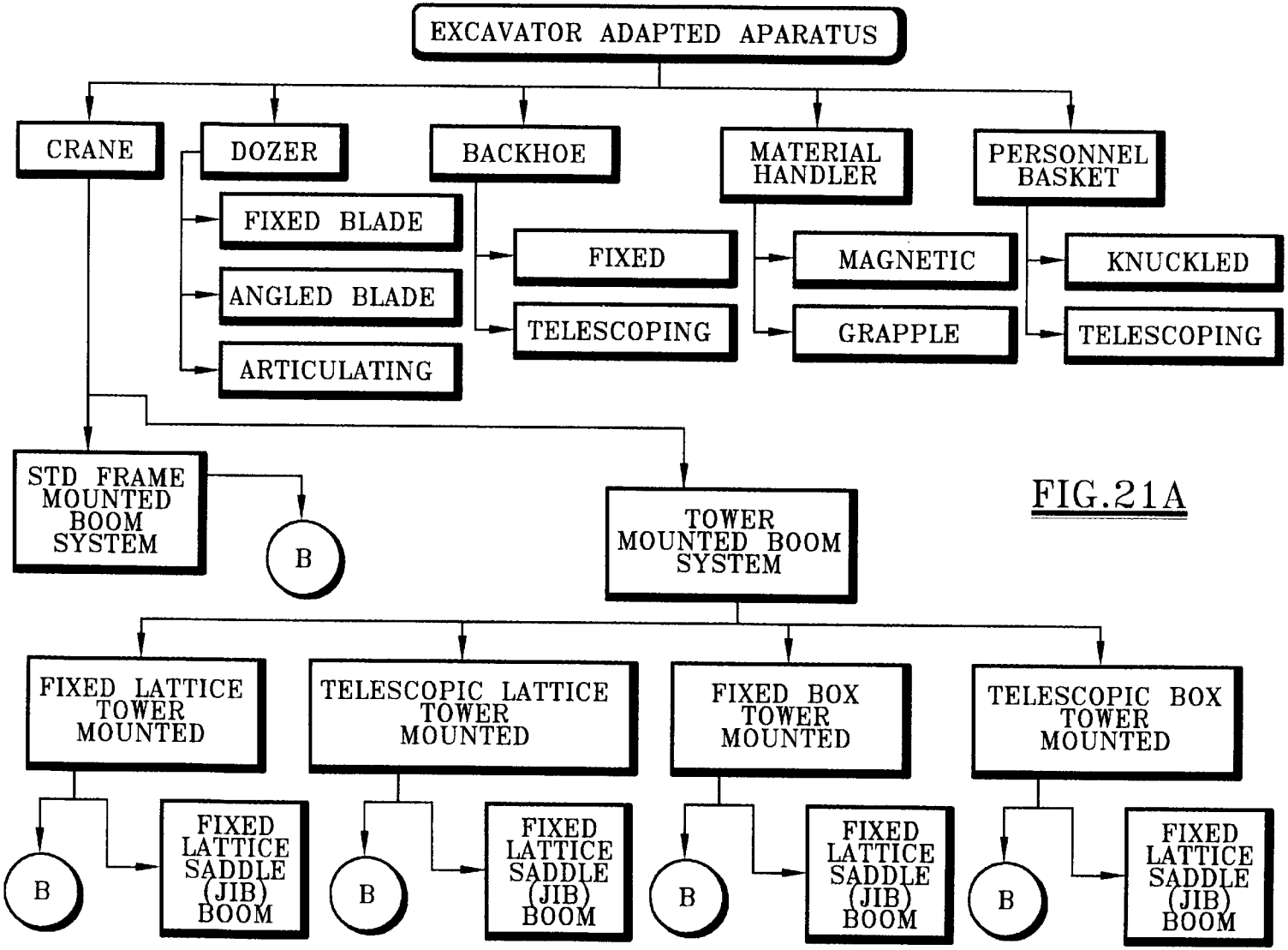
FIGS. 21A and 21B are flow charts illustrating examples of the various excavator adapted apparatus associated with the crane-excavator of the present invention with emphasis on various crane embodiments.
Figure 21B:
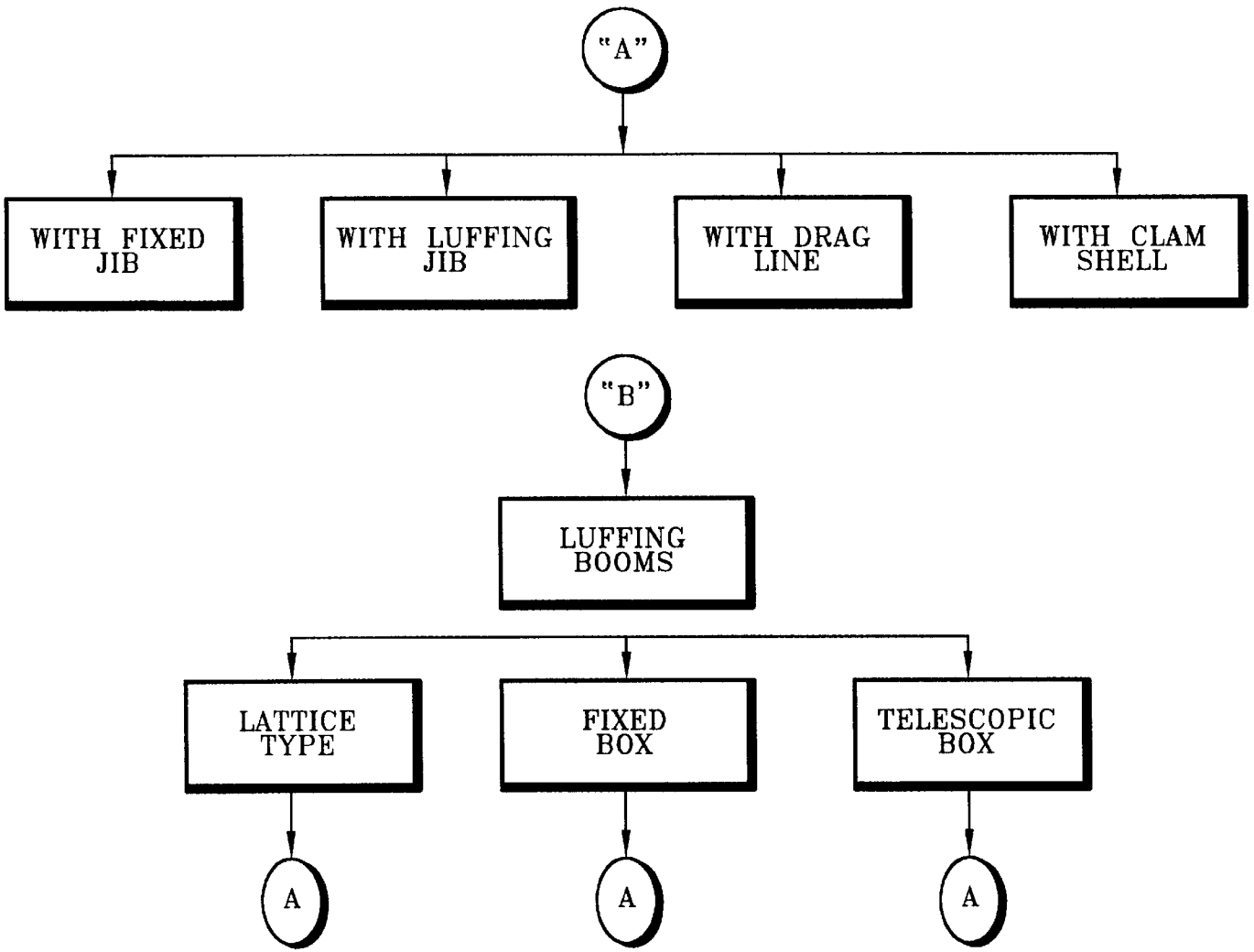

FIGS. 21A and 21B are flow charts illustrating examples of the various excavator adapted apparatus associated with the crane-excavator of the present invention with emphasis on various crane embodiments. FIG. 21A is a flow chart illustrating examples of the various excavator adapted apparatus associated with the crane-excavator of the present invention. FIG. 21B illustrates subcomponents of the excavator adapter apparatus available for use in the present invention as illustrated in FIG. 21A. It can be appreciated by those skilled in the art that additional apparatus can be adapted for use with the present invention and still be within the course and scope of the present invention. Particularly, by way of example, cranes, dozers, backhoes, material handlers and personnel baskets are examples of devices which can be adapted with respect to using excavators in practicing the present invention. Cranes can include box cranes, lower cranes, lattice cranes, drag lines and clam shells. A box crane can be telescopic or fixed. A lower crane can be telescopic or fixed. Also, the telescopic lower crane can have a saddle jib or a luffing jib. The fixed lower crane can have a telescopic or saddle jib, as well. The lattice crane can be adapted with a fixed jib or a luffing jib. Similarly, a dozer can have a fixed blade, an angled blade or an articulating blade. The backhoe can have fixed or telescoping elements. The material handler can use a magnetic adapter or a grapple. The personal basket can be knuckled or telescoping.

The conversion apparatus of the present invention can be described in terms of the physical parameters of the device utilized. The height of the conversion apparatus of the present invention can be up to 250 feet. The reach of the conversion apparatus of the present invention can be from approximately 4 feet to 250 feet. The reach of the devices can be from 4 feet to about 200 feet with a load of about 10 tons to 100 tons. The boom length of the conversion apparatus of the present invention can range from approximately 50 feet to over 250 feet. The conversion apparatus can be configured with or without a jib, and if a jib is used the jib can extend to approximately 250 feet. The above characteristics are illustrative of the range of characteristics of the conversion apparatus taught by the present invention. Other families of embodiments would have similar characteristics for the relevant applications. Further, the present invention can be considered in its simplest form an article of manufacture for converting, for example, an excavator into, for example a crane.

Figure 22:
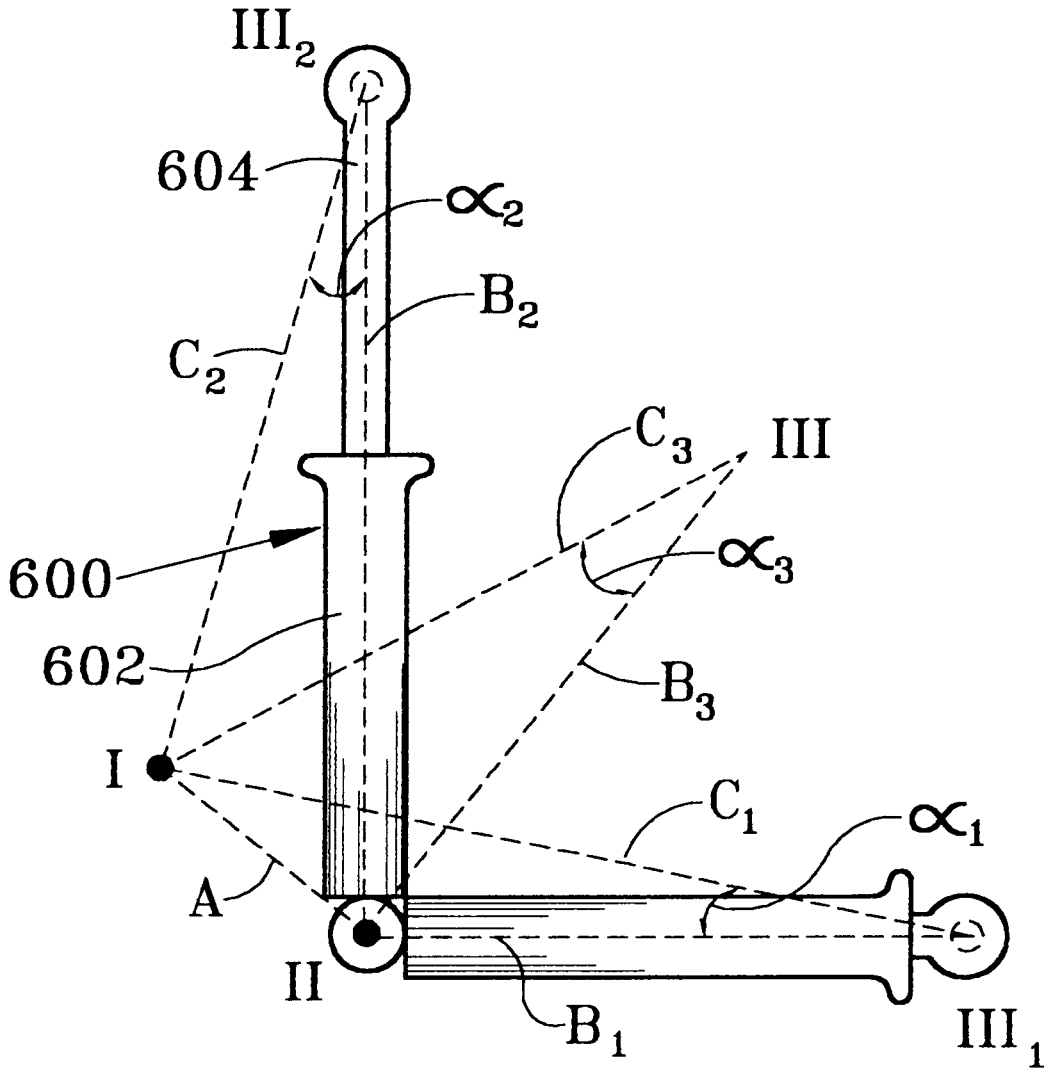
FIG. 22 is an illustration of varying luffing triangles practiced by the present invention in association with a cylinder.

FIG. 22 is an illustration of varying luffing triangles practiced by the present invention in association with a cylinder 600. The cylinder 600 has a sleeve 602 and a piston arm 604. The sleeve 601 accepts the piston arm 604 for telescoping into and out of the sleeve 601. The luffing triangle is represented by a boom foot location I, a cylinder foot location II, and a boom/cylinder location III. The boom foot location I, the cylinder foot location II, and the boom/cylinder location III are typically identified by a pin or another retaining mechanism. The boom foot location I and the cylinder foot location II are illustrated as stationary for the sake of the present discussion. However, it is appreciated that the positions of the boom foot location I and the cylinder foot location II are changed depending on the application and result to be accomplished. The positions of the boom/cylinder location III are illustrated at varying locations along the arc defined by the boom/cylinder location points $III_1$, $III_2$ and $III_3$. The luffing triangle is also defined by the sides A, B and C. The side A is defined to be between the boom foot location I and the cylinder foot location II. In FIG. 22, the side A is of a constant length. The side B is defined to be between the cylinder foot location II and the boom/cylinder location III. The side B varies in length depending on the configuration of the luffing triangle from shortest for side $B_1$ to longest for side $B_2$ with intermediate side $B_3$ therebetween. Similarly, the side C varies in length from the location of the sides at $C_1$, $C_2$ and $C_3$.

As illustrated in FIG. 22, it is advantageous to first determine the position of the boom foot location I. Then, the position of the cylinder foot location II may be determined. Thereafter, the position of the boom/cylinder location III may be determined. In determining the positions of the boom foot location I, the cylinder foot location II, and the boom/cylinder location III, several factors must be considered. Factors to be considered in determining an appropriate luffing triangle are, without limitation, the range of motion, the cylinder design, the capacity and the load capacity for each radius to be used. The luffing triangle is selected to have such dimensions as to provide a sufficient range of motion and a sufficient leverage to achieve a full or near-full capacity crane. In making range of motion and leverage determinations, considerations should be based upon the luffing triangle. For example, a larger apex angle, $\alpha$, typically provides better leverage.

Figure 23:
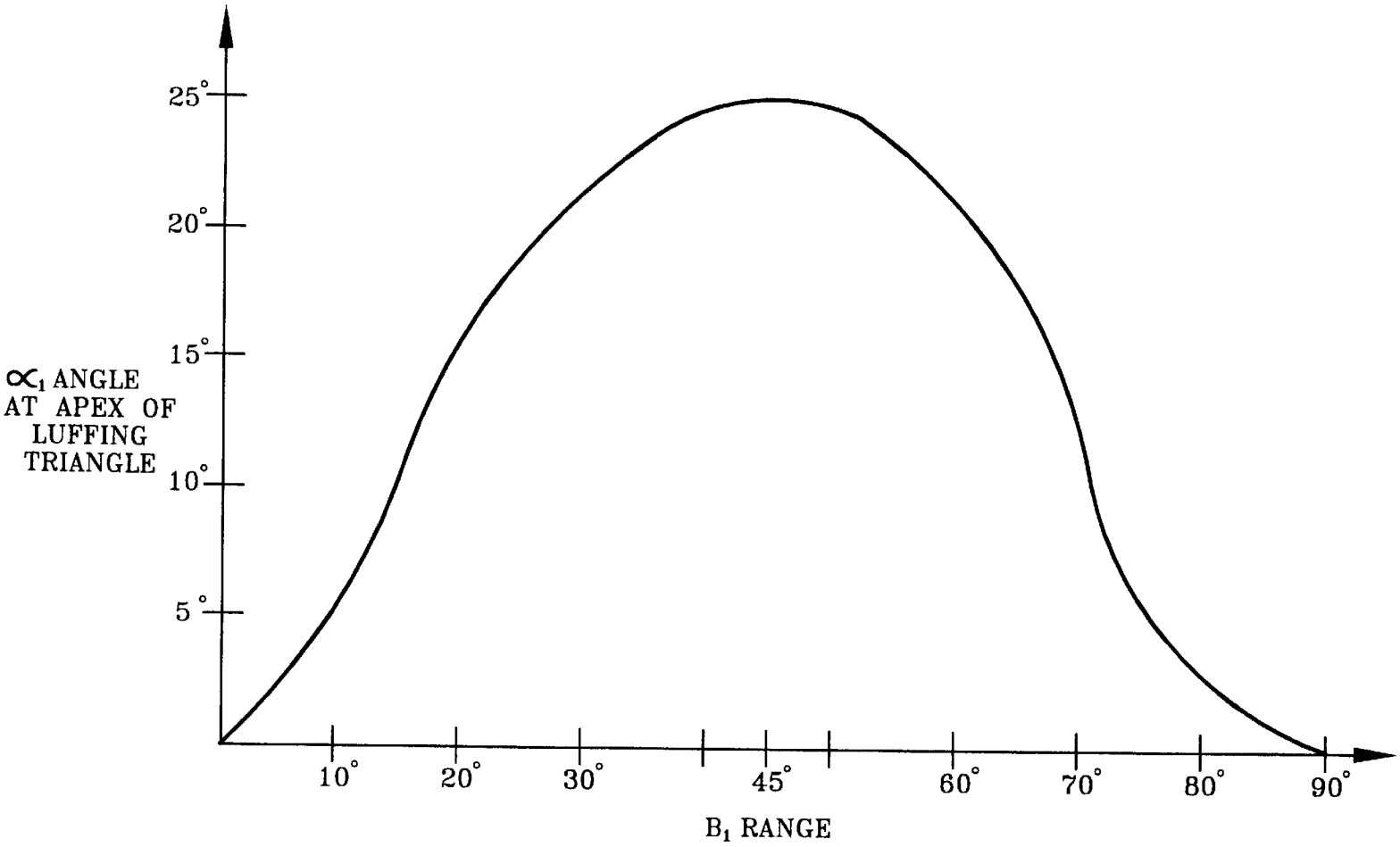
FIG. 23 is a graph of the magnitude of the angle at the apex of the luffing triangle versus the range of a cylinder.

FIG. 23 is a graph of the magnitude of the angle, $\alpha$, at the apex of the luffing triangle versus the range, $\beta$, of the cylinder as illustrated in FIG. 22. The curve of the angle, $\alpha$, at the apex of the luffing triangle versus the range, $\beta$, of the cylinder has been found to be Gaussian or "bell shaped." Thus, it has been determined to achieve enhanced results that it is better to operate at mid-range, $\beta$, conditions with a maximum angle, $\alpha$, at the apex of the luffing triangle.

Figure 24:
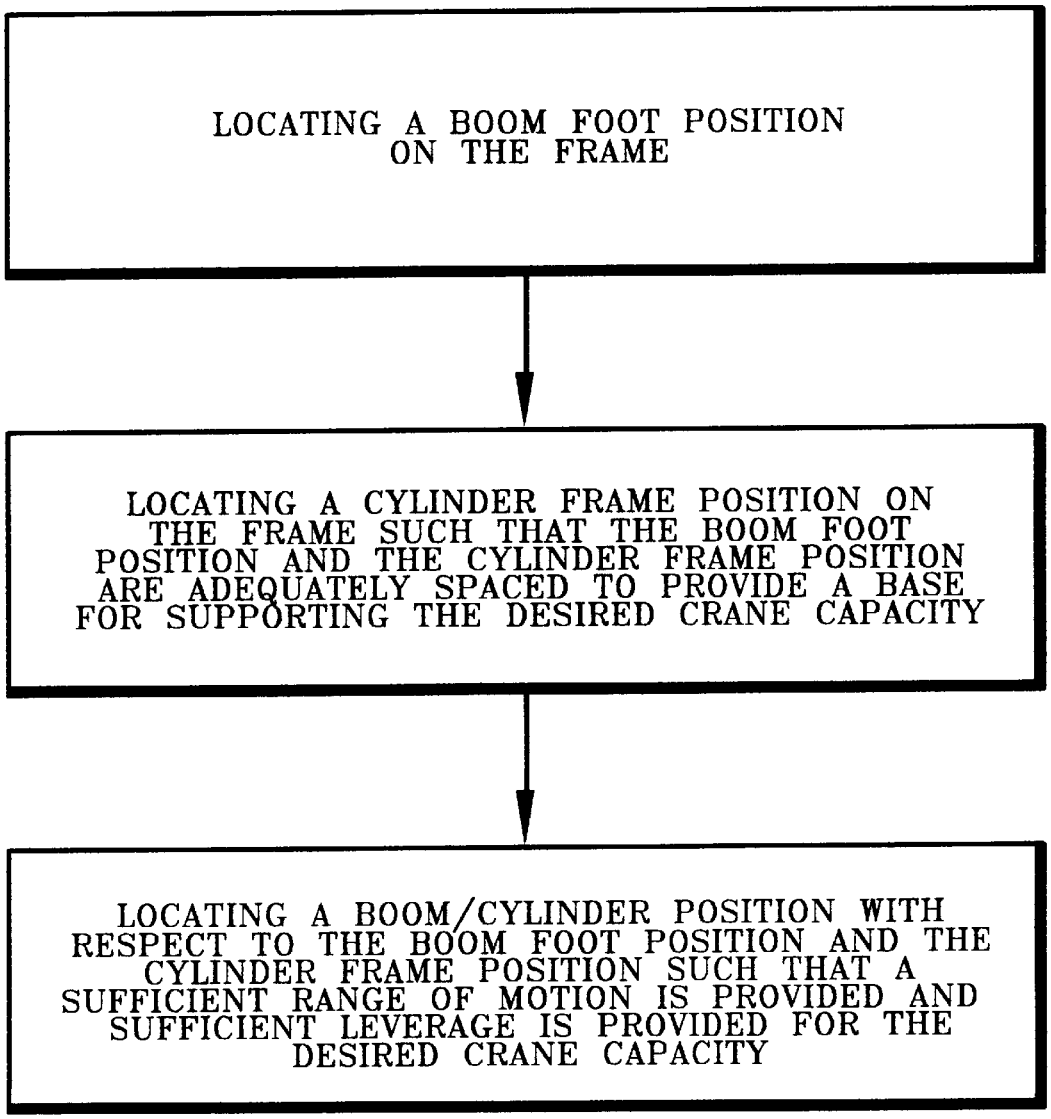
FIG. 24 is a flow chart illustrating a method associated with the luffing triangle of the present invention.

FIG. 24 is a flow chart illustrating a method associated with the luffing triangle of the present invention. The location of the boom foot position is determined. Then, the location of the cylinder frame position is determined. And, the location of the boom/cylinder position is determined. The boom foot position and the cylinder frame position are required to be adequately spaced to provide a base for supporting the desired crane capacity. The location of the boom/cylinder position with respect to boom foot position and the cylinder frame position is located such that a sufficient range of motion is provided and a sufficient leverage is provided for the desired crane capacity.

Additional advantages and modification will readily occur to those skilled in the art. The invention in its broader aspects is therefore not limited to the specific details, representative apparatus, and the illustrative examples shown and described herein. Accordingly, the departures may be made from the details without departing from the spirit or scope of the disclosed general inventive concept.

What is claimed is:

1. A crane for freely suspending a load above the ground comprising:

(a) a lower crawler adapted for use with an excavator, the lower excavator crawler comprising:
  (1) a first swivel at a position remote from the ground and
  (2) a continuous belt drive track for mobilizing the crane over the ground, (b) an upper body adapted for use with an excavator, the upper excavator body comprising:
  (1) a support member for providing structural integrity for the upper body,
  (2) a second swivel at a position proximate to the ground, and
  (3) a receptacle adapted to accept an excavator boom, the second swivel rotatably engaged with the first swivel of the lower excavator crawler for providing rotation of the upper excavator body upon the lower crawler when the lower crawler is stationary or mobilized, (c) a boom adapted to engage a crane body, the crane boom comprising:
  (1) a distal end having associated therewith at least one lifting device, and
  (2) a proximate end adapted to engage a crane body, and (d) an adapter for engaging the receptacle of the excavator upper body as if the adaptor was the excavator boom, the adaptor and the receptacle fixedly secured together such that the adaptor defines a connector for receiving the crane boom in the same manner as the crane boom would be accepted by a crane body for providing a range of boom angles comparable to the range of boom angles available to the boom connected to a crane body.

2. The crane as defined in claim 1 wherein the boom is telescoping.

3. The crane as defined in claim 1 further comprising a hoist in operative association with the crane boom.

4. The crane as defined in claim 1 further comprising a lifting device in operative association with the crane boom.

5. The crane as defined in claim 1 wherein the lifting device comprises an implement selected from the group of a sheave, a hook, an auxiliary hook, a main block, a whip line and a fast line.

6. A method for adapting an excavator for use as a crane, the method comprising the steps of:

(a) providing an assembly having:

a lower crawler adapted for use with the excavator, the lower crawler comprising:

a first swivel at a position remote from the ground and a continuous belt drive track for mobilizing the crane over the ground, an upper body adapted for use with the excavator, the upper body comprising:

a support member for providing structural integrity for the upper body, a second swivel at a position proximate to the ground, and a receptacle adapted to accept an excavator boom, the second swivel adapted to be rotatably engaged with the first swivel of the lower excavator crawler for providing rotation of the upper excavator body upon the lower crawler when the lower crawler is stationary or mobilized;

a boom adapted to engage a crane body, the boom comprising:

a distal end having associated therewith at least one lifting device, and a proximate end adapted to engage the crane body and, an adaptor capable of engaging the receptacle of the excavator upper body as if the adaptor was the excavator boom, the adaptor and the receptacle capable of being fixedly secured together such that, when secured, the adaptor defines a connection for receiving the crane boom in the same manner as the crane boom would be accepted by a crane body for providing a range of boom angles comparable to the range of boom angles available to the boom connected to a crane body, (b) disengaging, if connected, the excavator boom from the receptacle, (c) engaging an adaptor with the receptacle secured to the upper excavator body, the adaptor defining a connector for receiving the crane boom in the same manner as the crane boom would be accepted by a crane body for providing a range of boom angles comparable to the range of boom angles available to the boom connected to the crane body, (d) engaging the crane boom with the connector, and (e) articulating the crane boom with respect to the connector in such a manner as to provide an excavator-crane apparatus having the same operating and stability characteristics as a crane.

* * * * *